US011673719B2

(12) United States Patent
Skillin et al.

(10) Patent No.: US 11,673,719 B2
(45) Date of Patent: Jun. 13, 2023

(54) TWO-PIECE DROP DISPENSING CLOSURE

(71) Applicant: Silgan Dispensing Systems Slatersville, LLC, Slatersville, RI (US)

(72) Inventors: Clifford W. Skillin, Blackstone, MA (US); James Scotton, Foxborough, MA (US); Patrick J. Brannon, Warwick, RI (US); Chris Ettis, Providence, RI (US); David Royer, Pascoag, RI (US)

(73) Assignee: Silgan Dispensing Systems Slatersville, LLC, Slatersville, RI (US)

( * ) Notice: Subject to any disclaimer, the term of this patent is extended or adjusted under 35 U.S.C. 154(b) by 256 days.

(21) Appl. No.: 16/984,237

(22) Filed: Aug. 4, 2020

(65) Prior Publication Data

US 2022/0041347 A1 Feb. 10, 2022

(51) Int. Cl.

| | |
|---|---|
| ***B65D 47/18*** | (2006.01) |
| ***B65D 47/32*** | (2006.01) |
| ***B65D 41/34*** | (2006.01) |
| ***B05B 11/04*** | (2006.01) |

(52) U.S. Cl.

CPC ..... *B65D 47/18* (2013.01); *B05B 11/047* (2013.01); *B65D 41/3423* (2013.01); *B65D 47/32* (2013.01)

(58) Field of Classification Search

CPC ..... B65D 47/18; B65D 47/122

See application file for complete search history.

(56) References Cited

U.S. PATENT DOCUMENTS

| | | | | |
|---|---|---|---|---|
| 2,601,040 | A | 6/1952 | Livingstone | |
| 2,783,923 | A * | 3/1957 | Croce | B65D 47/18 222/421 |
| 3,059,816 | A | 10/1962 | Goldstein | |
| 3,168,221 | A | 2/1965 | Parker | |
| 3,323,691 | A * | 6/1967 | Ruetz | B65D 47/18 222/479 |
| 4,193,519 | A | 3/1980 | Dubach et al. | |
| D265,060 | S | 6/1982 | Blank | |
| D306,265 | S | 2/1990 | Leebeek | |
| 5,071,037 | A | 12/1991 | Moore et al. | |
| 5,119,975 | A | 6/1992 | Jemielita | |
| 5,141,138 | A | 8/1992 | Odet et al. | |
| 5,221,017 | A | 6/1993 | Cistone et al. | |
| 5,289,950 | A | 3/1994 | Gentile | |
| D350,482 | S | 9/1994 | Hu et al. | |

(Continued)

FOREIGN PATENT DOCUMENTS

| | | | |
|---|---|---|---|
| CN | 105636875 | B | 9/2018 |
| DE | 2531690 | A1 | 2/1977 |

(Continued)

*Primary Examiner* — Paul R Durand
*Assistant Examiner* — Michael J. Melaragno
(74) *Attorney, Agent, or Firm* — Hinckley, Allen & Snyder, LLP; Stephen Holmes

(57) ABSTRACT

A two-piece dispensing closure for dispensing essential oils includes an insert received into a container opening and a closure body including a dispensing spout and a hinged cap. The cap is connected to the closure body by a living hinge to allow the user to selectively open and close the container. A tamper-evident tear strip is integrally formed with the closure body. The insert and the closure body including mating helical ramps which cooperate to insure that the insert remains installed within the container neck when the closure body is removed after purchase.

20 Claims, 12 Drawing Sheets

(56) References Cited

U.S. PATENT DOCUMENTS

| | | | | |
|---|---|---|---|---|
| D350,611 | S | 9/1994 | Scales | |
| D362,186 | S | 9/1995 | Fhanisch | |
| D367,424 | S | 2/1996 | Fhanisch | |
| D399,744 | S | 10/1998 | Gross | |
| 6,170,719 | B1 | 10/2001 | Wilkinson et al. | |
| D519,029 | S | 4/2006 | Hicks et al. | |
| D537,342 | S | 2/2007 | Smith et al. | |
| D538,161 | S | 3/2007 | Smith et al. | |
| D578,000 | S | 10/2008 | Zoppas | |
| D585,278 | S | 1/2009 | Wilson et al. | |
| D585,741 | S | 2/2009 | Wilson et al. | |
| D585,742 | S | 2/2009 | Wilson et al. | |
| D592,057 | S | 5/2009 | Guerin | |
| D598,752 | S | 8/2009 | Wilson et al. | |
| D630,093 | S | 1/2011 | Bardet | |
| D640,134 | S | 6/2011 | Rognard | |
| D672,650 | S | 12/2012 | Wisniewski et al. | |
| D672,651 | S | 12/2012 | Gregory et al. | |
| D673,044 | S | 12/2012 | Wisniewski | |
| D681,458 | S | 5/2013 | Santarelli | |
| D686,077 | S | 7/2013 | Stull, Sr. et al. | |
| 9,010,590 | B2 | 4/2015 | Kallenbach et al. | |
| 9,334,097 | B2 | 5/2016 | Skillin et al. | |
| 9,371,165 | B2 | 6/2016 | Brannon et al. | |
| D768,490 | S | 10/2016 | Robinson et al. | |
| D775,950 | S | 1/2017 | Rognard | |
| 9,884,706 | B1 | 2/2018 | Skillin et al. | |
| 10,414,557 | B2 * | 9/2019 | Skillin | B65D 41/34 |
| 10,625,911 | B1 * | 4/2020 | Laible | B67D 7/0294 |
| 2004/0011812 | A1 | 1/2004 | Kasting et al. | |
| 2005/0279727 | A1 | 12/2005 | Graswald et al. | |
| 2006/0131330 | A1 * | 6/2006 | Stebick | B65D 47/40 222/109 |
| 2008/0169261 | A1 | 7/2008 | Druitt et al. | |
| 2009/0134188 | A1 | 5/2009 | Wilson et al. | |
| 2009/0250488 | A1 | 10/2009 | Dubach | |
| 2012/0074180 | A1 | 3/2012 | Kallenbach et al. | |
| 2013/0056501 | A1 | 3/2013 | Beike et al. | |
| 2013/0175273 | A1 | 7/2013 | Fox | |
| 2014/0252034 | A1 | 9/2014 | Brannon et al. | |
| 2015/0025506 | A1 | 1/2015 | Chau | |
| 2015/0048113 | A1 | 2/2015 | Brannon et al. | |
| 2015/0048124 | A1 | 2/2015 | Wisniewski | |
| 2015/0090743 | A1 | 4/2015 | Wisniewski et al. | |
| 2016/0016703 | A1 | 1/2016 | Muhlemann | |
| 2016/0244219 | A1 | 8/2016 | Benoit-Gonin et al. | |
| 2016/0375452 | A1 | 12/2016 | Skillin | |
| 2017/0050773 | A1 | 2/2017 | Rognard et al. | |
| 2018/0111723 | A1 * | 4/2018 | Skillin | B65D 47/0838 |
| 2018/0319555 | A1 * | 11/2018 | Sprick | B65D 51/18 |
| 2021/0039850 | A1 * | 2/2021 | Buzzi | B65D 55/024 |
| 2022/0041347 | A1 * | 2/2022 | Skillin | B65D 47/32 |

FOREIGN PATENT DOCUMENTS

| | | | | |
|---|---|---|---|---|
| JP | 2006207957 | A | 8/2006 | |
| WO | WO-0189983 | A1 * | 11/2001 | B65D 47/0809 |

* cited by examiner

TWO-PIECE DROP DISPENSING CLOSURE

BACKGROUND OF THE INVENTION (1) Field of the Invention: The instant invention relates to dispensing closures for containers and more specifically to a two-piece dispensing closure for precise dispensing of measured drops of essential oils or other fluids.

(2) Description of Related Art: Dispensing containers are used in a variety of industries for dispensing of various liquid products. For example, dispensing containers may be used for shampoo, lotion, condiments, beverages or oils. As integrated dispensing closures become more prevalent in all industries, consumers push for their use on an ever-expanding array of products and packages, and product manufacturers push for unique solutions and reduced costs to promote sales.

SUMMARY OF THE INVENTION

A drop dispensing closure for precisely dispensing drops of essential oils or other fluids from a container with a threaded neck includes an insert body which is received into the neck of the container and a closure body received around the insert body and threadably onto the container neck. The present dispensing closure components include mating helical surfaces which are particularly configured and arranged to insure that the insert body remains inserted within the container neck when the closure body is removed after purchase and to maintain alignment of the dispensing spout during re-assembly by the consumer.

The container in the exemplary embodiment is a glass bottle for containing essential oils which are dispensed in small quantities for aromatic, topical or internal use. The bottle container includes a body portion and an outwardly threaded neck.

The insert body comprises a drainback well, a vent tube extending from the drainback well, a dispensing orifice in the drainback well, a radial flange extending outward from the drainback well, and circumferentially spaced helical ramps on an upper surface of the flange, encircling the drainback well.

The closure body comprises an annular closure deck having an inner peripheral edge and an outer peripheral edge, an annular inwardly threaded mounting skirt about the peripheral outer edge, circumferentially spaced helical ramps on a lower surface of the closure deck encircling the inner peripheral edge, and a cap connected to said mounting skirt with a living hinge.

The bottle neck and mounting skirt are provided with clockwise oriented threads for clockwise closure rotation (downward linear translation). The mating helical surfaces on the closure and insert are configured to form a counterclockwise ratcheting (engagement) movement. Clockwise rotation of the closure during mounting engages the opposing end wall of the ramps, rotating the insert body with the closure body and driving the insert body downwardly into the neck opening. The 120 degree spacing of the three helical ramps insures that the dispensing orifice is aligned forwardly. Conversely, during counterclockwise unscrewing of the closure (upward translation), the cooperating helical surfaces slide relative to each other but also create an opposing downward translation force on the insert body thereby maintaining the insert body within the container neck as the closure body is removed. Retention of the insert body within the container neck is a significant safety feature to prevent unwanted access to the full contents of the container. Many essential oils contained within these types of dispensing systems are potent and preventing unwanted spillage or accidental dispensing of large doses is a critical safety concern.

Some embodiments may include a tamper-evident skirt ring that is connected to a lower peripheral edge of the mounting skirt by a plurality of frangible security elements. Removal of the closure from the bottle or container prior to purchase will sever the frangible elements clearly indicating tampering with the product.

Embodiments of the invention may include a tamper-evident tear strip that prevents a user from opening a cap without at least partially detaching the tear strip from the cap.

Some embodiments of the invention may include dual hermetic seals surrounding the drainback recess and dispensing spout.

Some embodiments of the invention may include a plug seal with the bottle neck and/or a plug seal in or around the dispensing spout.

While embodiments of the invention have been described as having the features recited, it is understood that various combinations of such features are also encompassed by particular embodiments of the invention and that the scope of the invention is limited by the claims and not the description.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
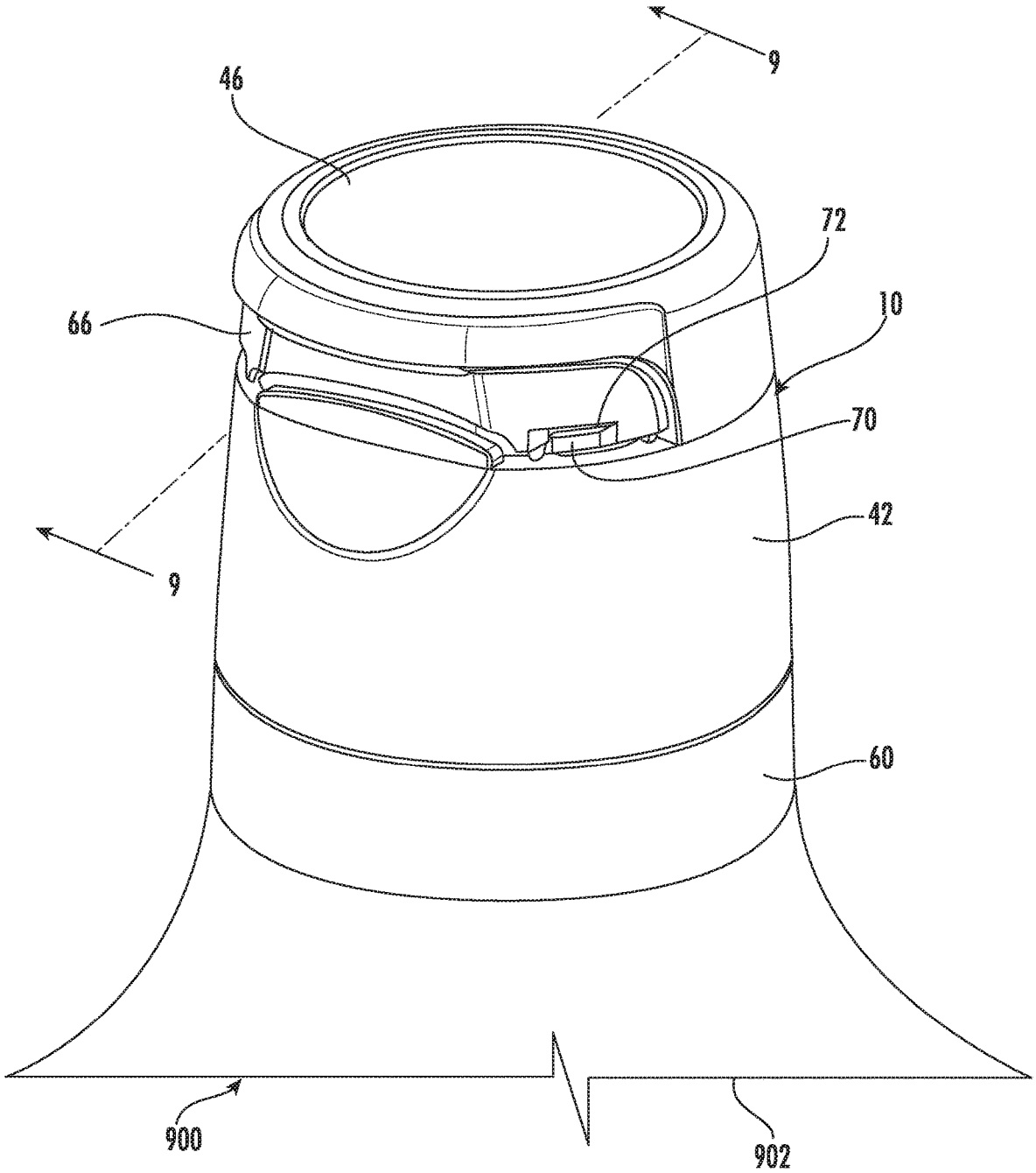
FIG. 1 is a perspective view of an exemplary embodiment of two-piece drop dispensing closure in accordance with the present invention.

Referring now to the drawings, a dispensing closure according to the exemplary embodiments of the invention is illustrated and generally indicated at 10 in FIGS. 1-16. As will hereinafter be more fully described, the dispensing closure 10 provides a two-piece dispensing closure for dispensing oils or other fluids from a bottle-like container 900 having a threaded neck (See FIGS. 1 and 9).

The container 900 in the exemplary embodiments may comprise a bottle (glass or plastic) for containing essential oils (or other fluids) which are dispensed in small measured quantities (drops) for aromatic, topical and/or internal use. Generally, the container 900 includes a body portion 902 and an outwardly threaded neck 904 (See FIG. 9). The shape of the body portion of the container 900 is not critical to the invention.

The dispensing closure 10 is particularly effective for precisely dispensing measured drops of essential oils, or other fluids as described above, which may have differing viscosities and potencies across a broad product range.

An exemplary embodiment of the closure 10 includes an insert body 12 which is received into the neck 904 of the container 900 and a closure body 14 received around the insert body 12 and threadably or otherwise connected to the container neck 904.

Generally, the dispensing closure components 12, 14 may include mating helical ratcheting surfaces which are particularly configured and arranged to insure that the insert body 12 remains inserted within the container neck 904 if the closure body 14 is removed after purchase and to maintain alignment of the dispensing spout during re-assembly by the consumer.

Figure 9:
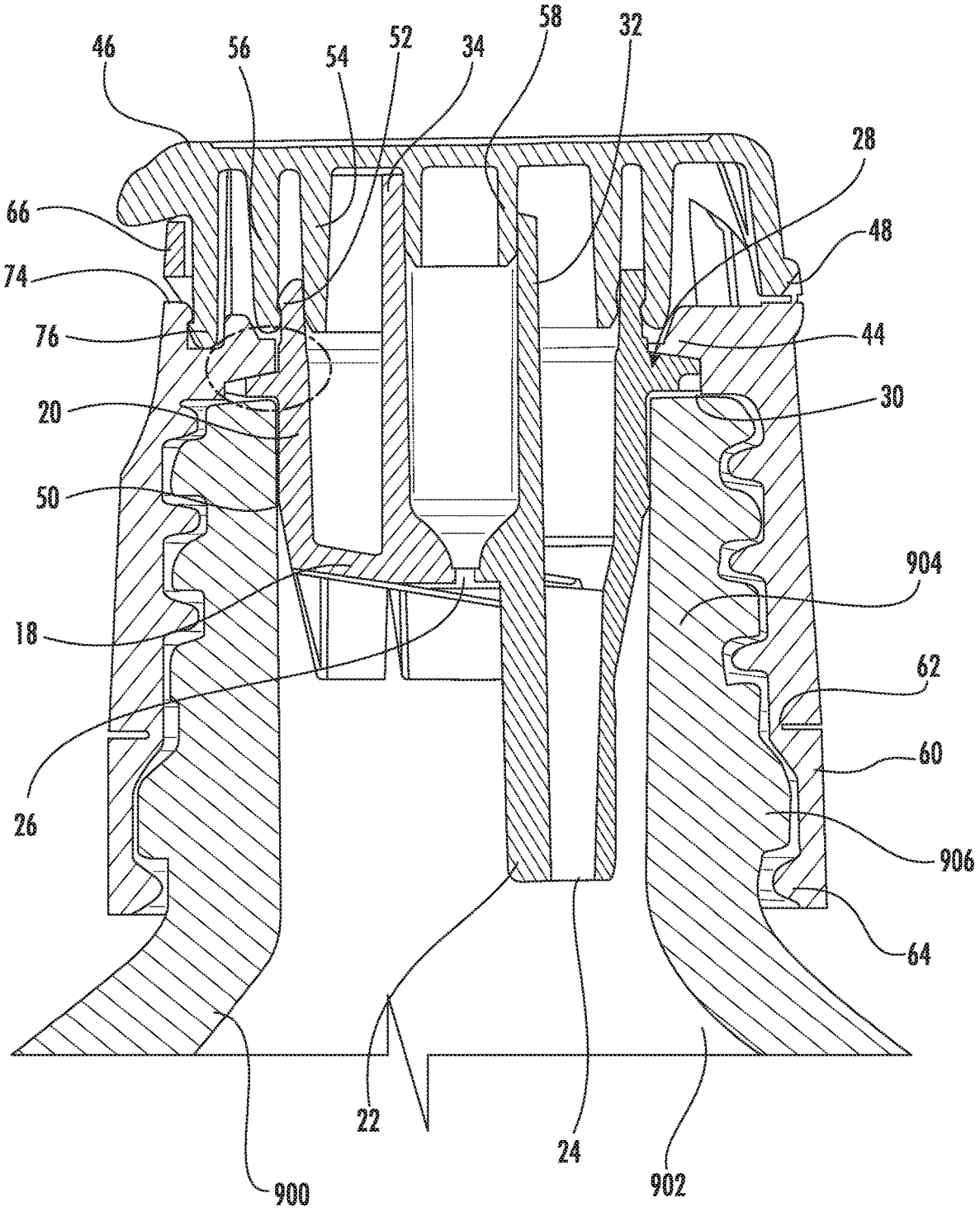
FIG. 9 is a cross-sectional view thereof taken along line 9-9 of FIG. 1.
Figure 10:
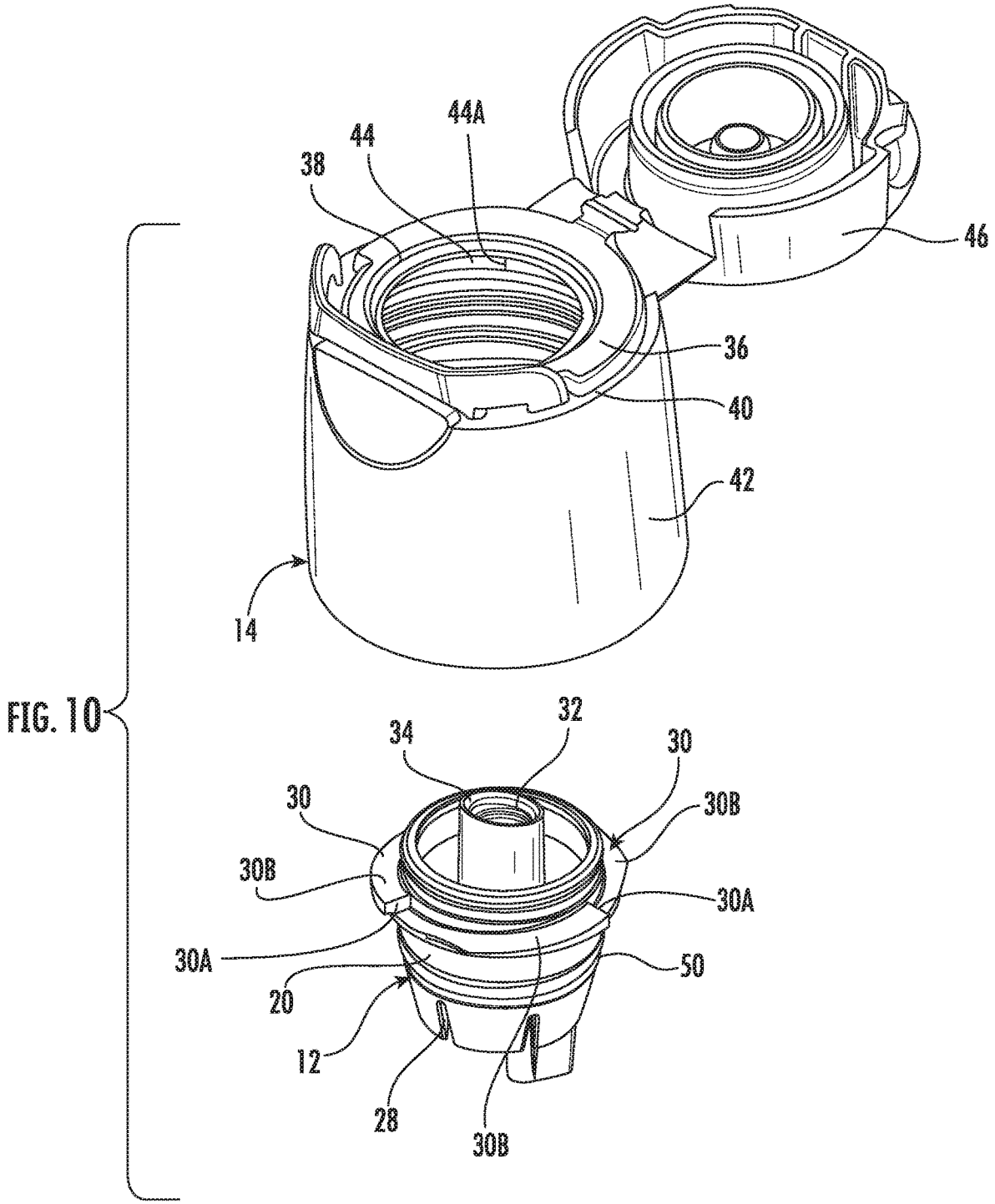
FIG. 10 is an exploded perspective view thereof.
Figure 11:
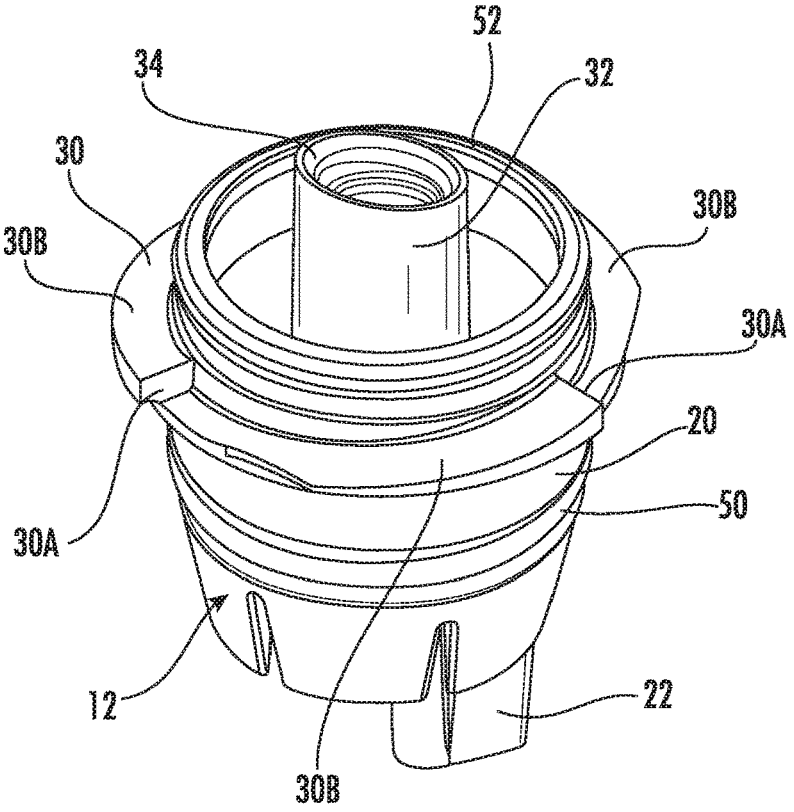
FIG. 11 is a perspective view of the insert body.
Figure 12:
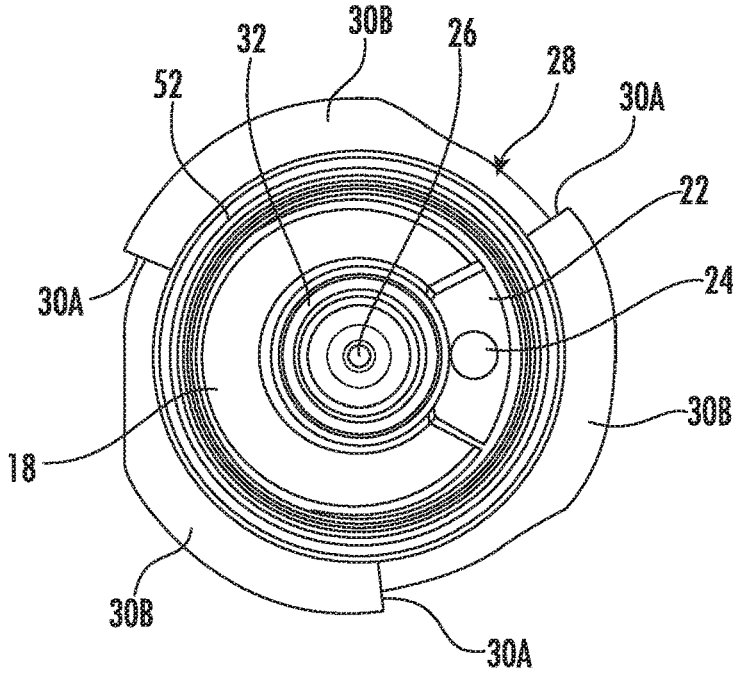
FIG. 12 is a top view thereof.
Figure 13:
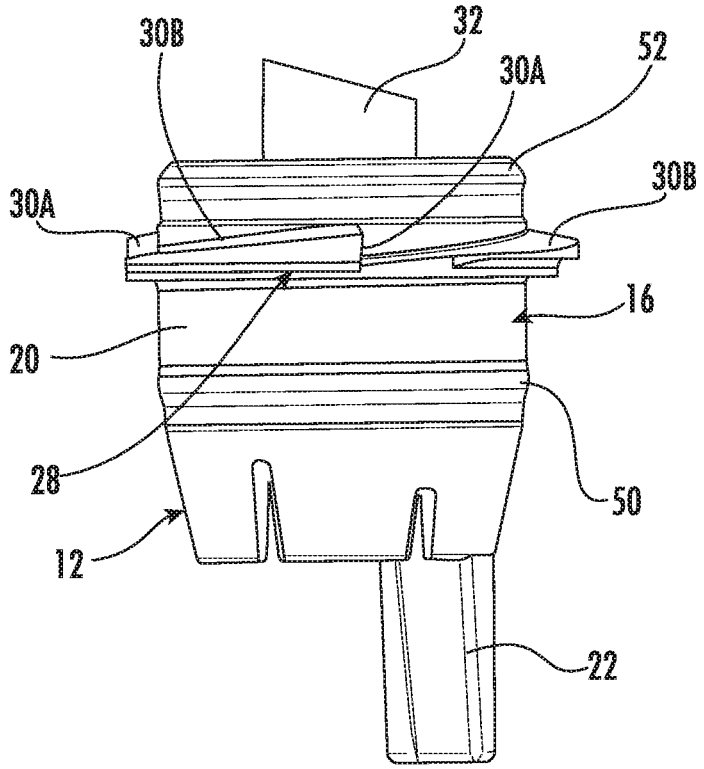
FIG. 13 is a side view thereof.
Figure 14:
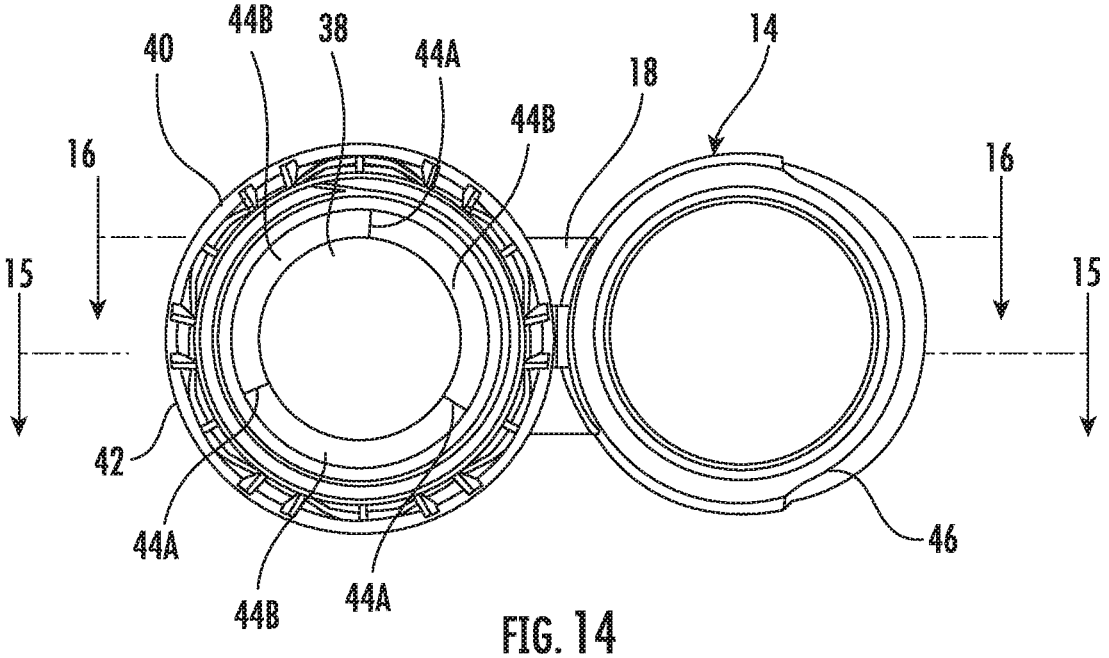
FIG. 14 is a bottom view thereof of the closure body.

As best seen in FIGS. 9-13, in some embodiments the insert body 12 comprises a drainback well 16 having a bottom wall 18 and a side wall 20 and a vent tube 22 extending downwardly from the bottom wall of the drainback well. The vent tube 22 has a vent opening 24 at a bottom end thereof. A dispensing orifice 26 is located in the bottom wall of the drainback well and a radial flange 28 extends outward from the drainback well side wall 20. Circumferentially spaced helical ramps 30 are located on an upper surface of the flange 28, encircling the drainback well 16. Referring to FIG. 9 (see encircled area) and 13, it can be seen that the helical ramps 30 have a slight outward and downward taper, thinner at the outward edge thereof.

A tubular dispensing spout 32 extends upwardly from the bottom wall 18 of the drainback well 16 surrounding the dispensing orifice 26. While there are provided certain disclosures herein for the exemplary embodiments which are effective for dispensing of the noted essential oils, the invention has broader applicability to other fluids, and the disclosure should not be specifically limited to these examples per se.

The spout 32 is provided with a drip lip 34 having a leading drip edge and a trailing edge, the drip lip 34 being downwardly angled from the leading edge towards the trailing edge, i.e. angled from the front towards the rear side of the closure 10. The leading edge of the drip lip 34 has an acute edge angle of less than 45 degrees to provide a clean drop cut off which minimizes drainback. The bottom wall 18 of the drainback well 16 is also downwardly sloped from the leading edge of the drip lip 34 towards the trailing edge, and the vent tube 22 is located on the trailing edge side (downward slope side) of the drip lip 34. It is noted that the vent opening 24 also functions as the drainback opening into the interior of the container 900. The location of the vent tube 22 at the rear side of the closure 10 assists in allowing free venting air flow during dispensing of the product. It can be appreciated that when the container 900 is inverted and tipped to dispense the product, the vent tube 22 and vent opening 24 will be located above the oil or product level in the container 900, thereby providing a free path for air to enter the interior of the container 900 during dispensing.

Figure 2:
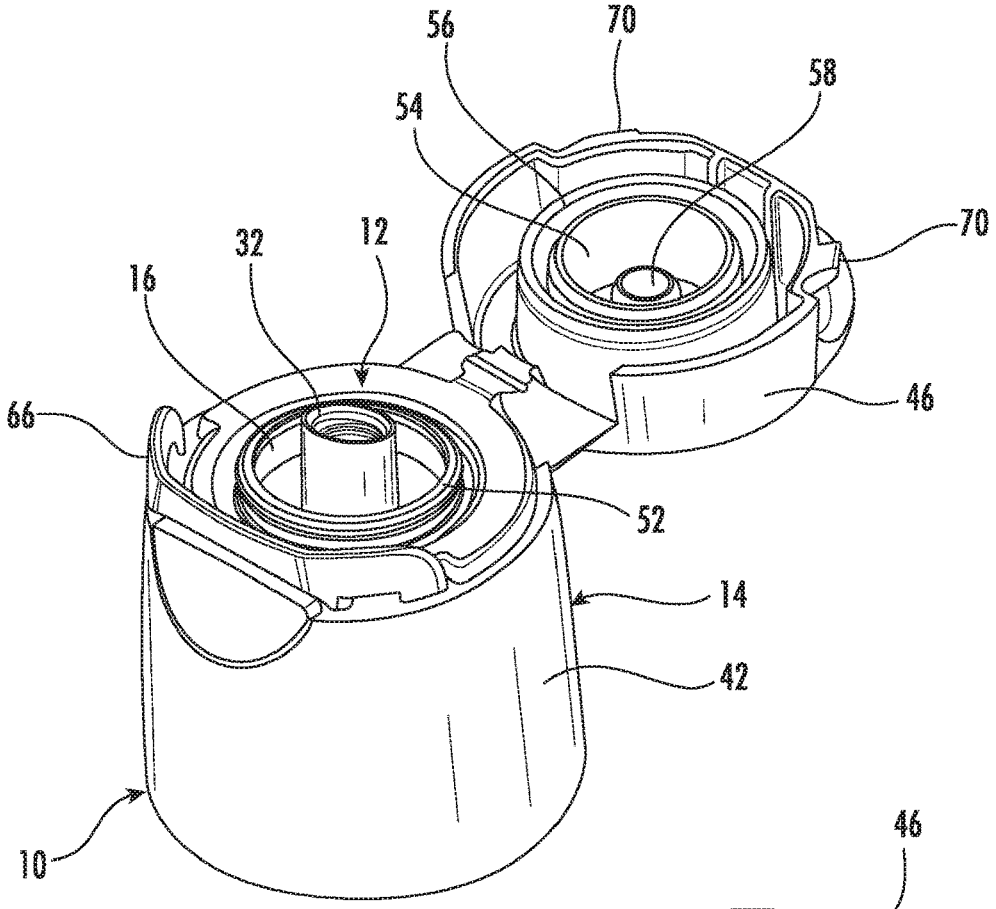
FIG. 2 is another perspective view thereof with the cap in an open position.
Figure 3:
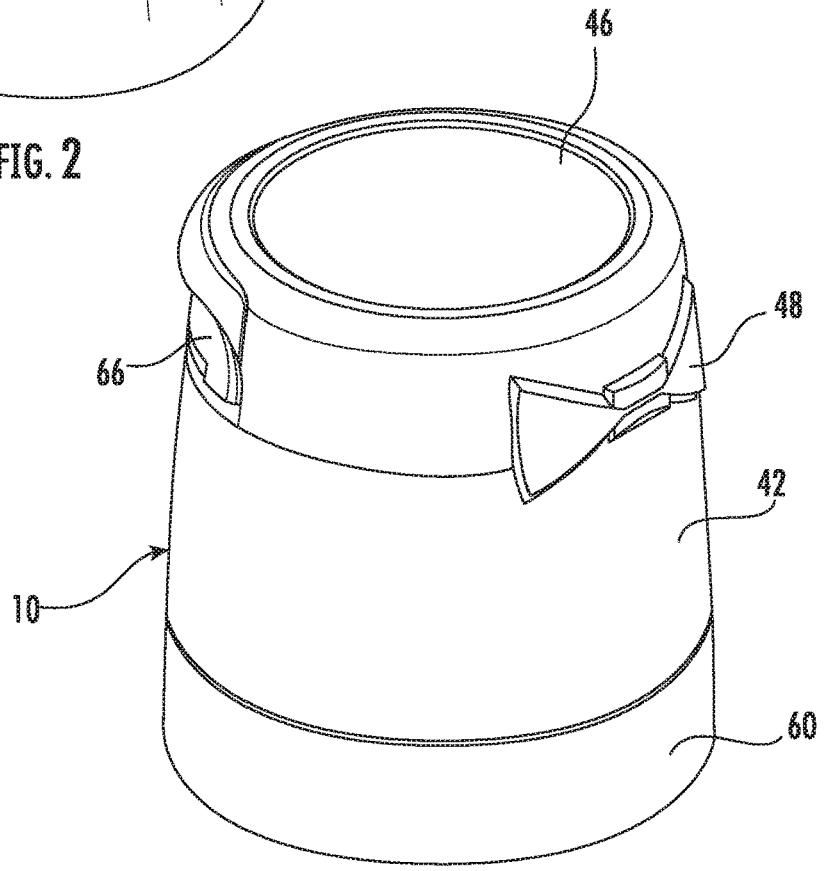
FIG. 3 is yet another perspective view thereof from the rear.
Figure 4:
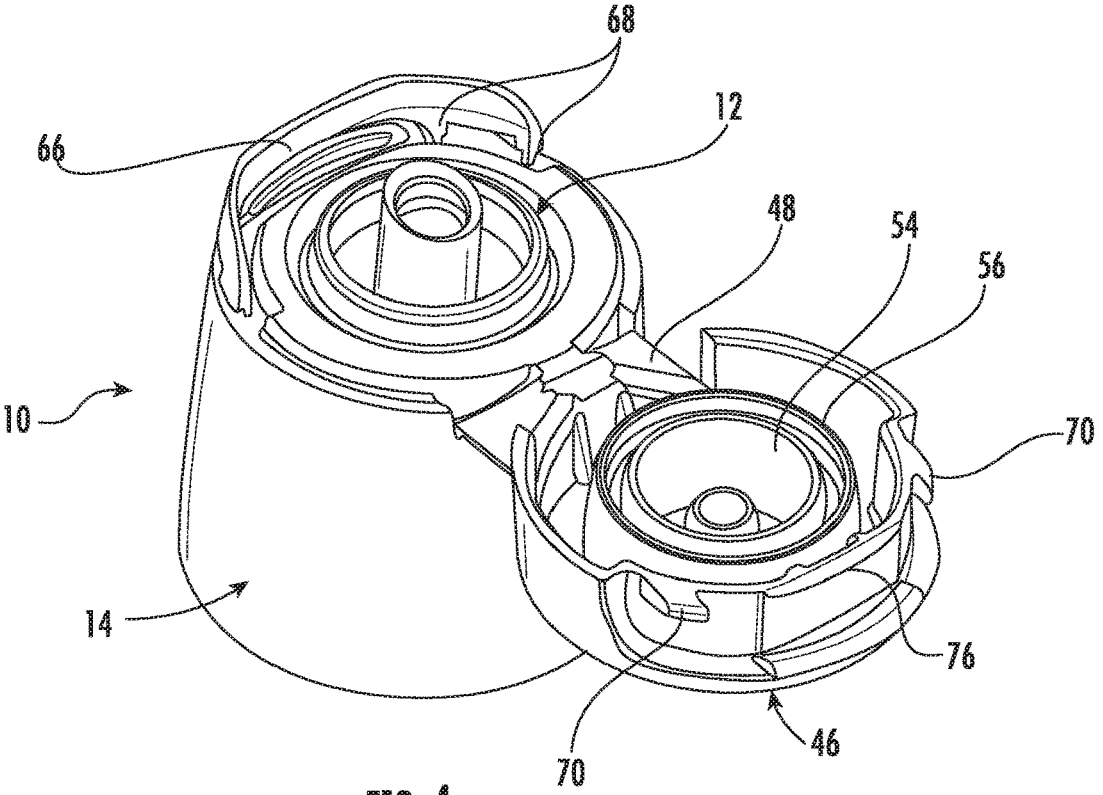
FIG. 4 is a perspective view thereof from the rear with the cap open.

As best seen in FIGS. 9, 10, 15 and 16, the closure body 14 comprises an annular closure deck 36 having an inner peripheral edge 38 and an outer peripheral edge 40 and an annular inwardly threaded mounting skirt 42 extending about the peripheral outer edge 40. Circumferentially spaced helical ramps 44 are located on a lower surface of the closure deck 36 encircling the inner peripheral edge 38. As described above, the helical ramps 44 have a slight outward and downward tilt. A cap 46 is connected to the mounting skirt 42 with a living hinge 44 such as the illustrated bowtie living hinge. The living hinge 44 provides for hinged movement of the cap 46 between a closed position (FIGS. 1 and 3) and an open position for dispensing (FIGS. 2 and 4).

Figure 15:
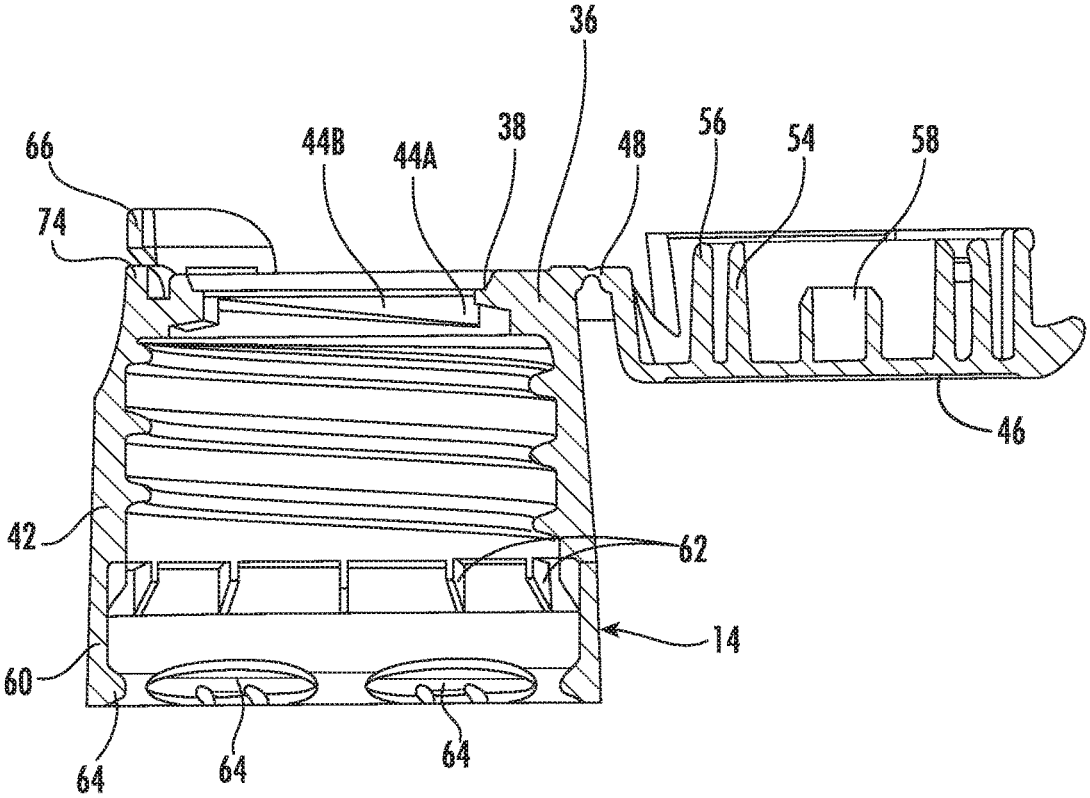
FIG. 15 is a cross-sectional view thereof taken along line 15-15 of FIG. 14.
Figure 16:
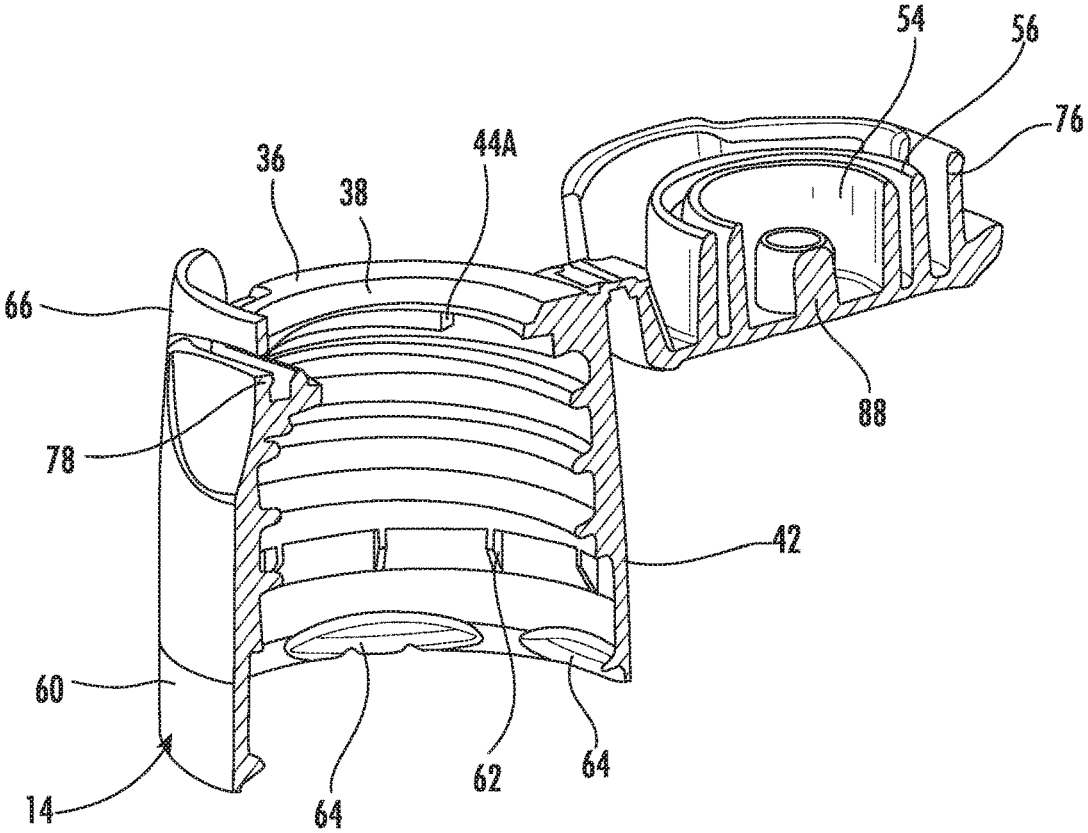
FIG. 16 is a cross-sectional view thereof taken along line 16-16 of FIG. 14.

Referring to FIGS. 9, 15 and 16, the bottle neck 904 and mounting skirt 42 are provided with clockwise oriented threads for clockwise closing or mounting rotation (downward linear translation of the closure body 14 relative to the container 900). In contrast, the mating helical surfaces on the closure body 14 and insert body 12 are configured to form a counterclockwise ratcheting (engagement) movement. It should be noted here that the initial assembly of the insert body 12 and closure body 14 with the container neck 904 at the manufacturer is completed in a press-fit operation so that the forward lip of the dispensing spout 32 is oriented and in alignment with the hinge 44. There may be occasions where the user may want to remove the closure body 14 and/or insert body 12. However, retention of the insert body 12 within the container neck 904 is a significant safety feature to prevent unwanted or inadvertent access to the full contents of the container. Many essential oils contained within these types of dispensing systems are potent and preventing unwanted spillage or accidental dispensing of large doses is a critical safety concern.

In this regard, during counterclockwise unscrewing of the closure body 14 (upward translation of the closure body 14 relative to the container 900), the cooperating helical ramp surfaces 30B, 44B slide relative to each other creating an opposing downward translation force on the insert body 12 thereby maintaining the insert body 12 within the container neck 904 as the closure body 14 is removed. Thereafter, the user would need to forcibly remove the insert body 12 from the container neck 904.

Conversely, clockwise rotation of the closure body 14 during re-mounting or re-assembly engages the opposing end walls 30A, 44A of the ramps 30, 44 (See FIG. 10), rotating the insert body 12 with the closure body 14 and driving the insert body 12 downwardly into the neck opening 904. The helical ramps 30, 44 may in some embodiments comprise 3 helical ramps spaced 120 degrees apart which insures that the dispensing orifice 26 and spout 32 are aligned in a forwardly facing position (although offset slightly by the 120 degree spacing) when the closure body 14 is engaged. The dispensing closure 10 is effective in these offset positions as long as the dispensing lip of the spout 32 is not more than 120 degrees offset.

The outside surface of the side wall 20 of the drainback well 16 is contoured and sized for frictional sealing engagement with the inner surface of the container neck 904 to provide a seal when the closure body 14 is threadably received thereon (see FIG. 9). The outside surface may include an interference or sealing bead 50 for a tight seal with the inner surface of the container neck 904.

To provide a hermetic seal between the closure body 14 and cap 46, an annular sealing lip 52 extends upwardly from the drainback well 16 while the cap 46 includes concentrically spaced annular sealing walls 54, 56 depending downwardly from an upper wall thereof. The annular sealing lip 52 includes a sealing bead at the upper peripheral edge which extends both radially inward and outward (See FIG. 9). The concentric annular sealing walls 54, 56 respectively include sealing beads extending toward the sealing lip 52. When the cap 46 is in the closed position (FIG. 9), the annular sealing walls 54, 56 engage with the annular sealing lip 52 to form a dual hermetic seal on both the outside and inside of the sealing lip 52. The hermetic seal preserves the quality of the product within the container 900 and prevents evaporation over extended periods of storage between uses.

To further seal the container, the cap 46 further includes a plug seal 58 depending downwardly from the upper wall which concentrically engages with the interior of the spout 32 to form another seal.

Figure 5:
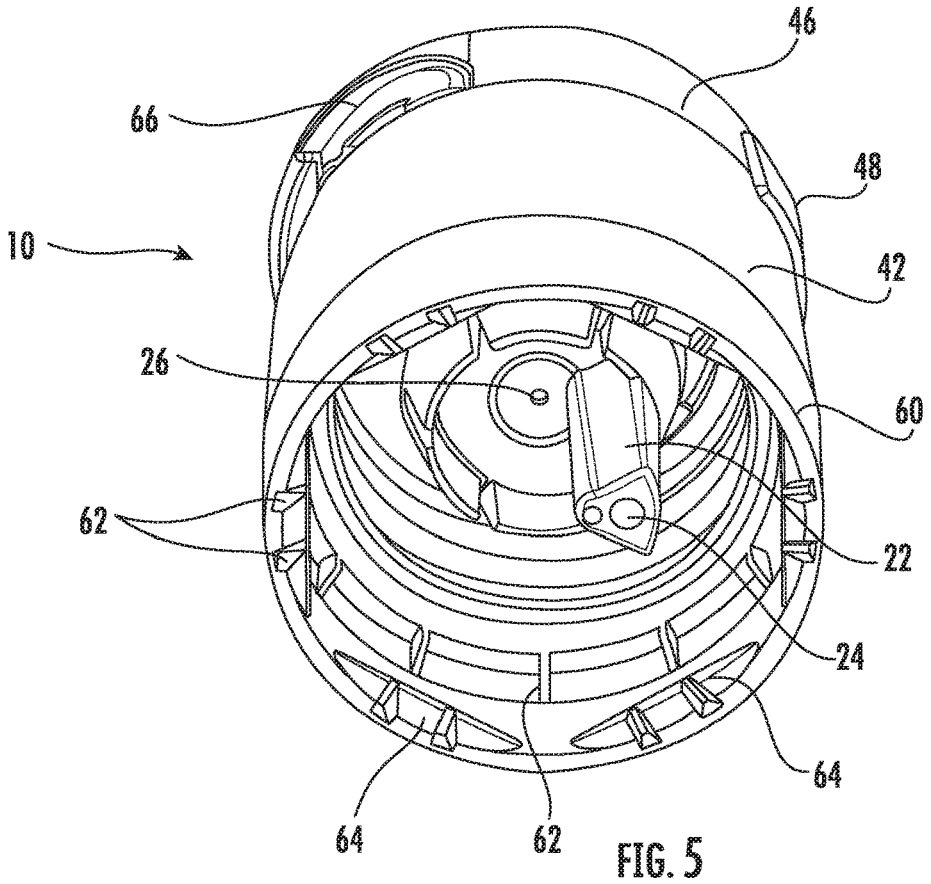
FIG. 5 is still another perspective view thereof from the bottom.
Figure 6:
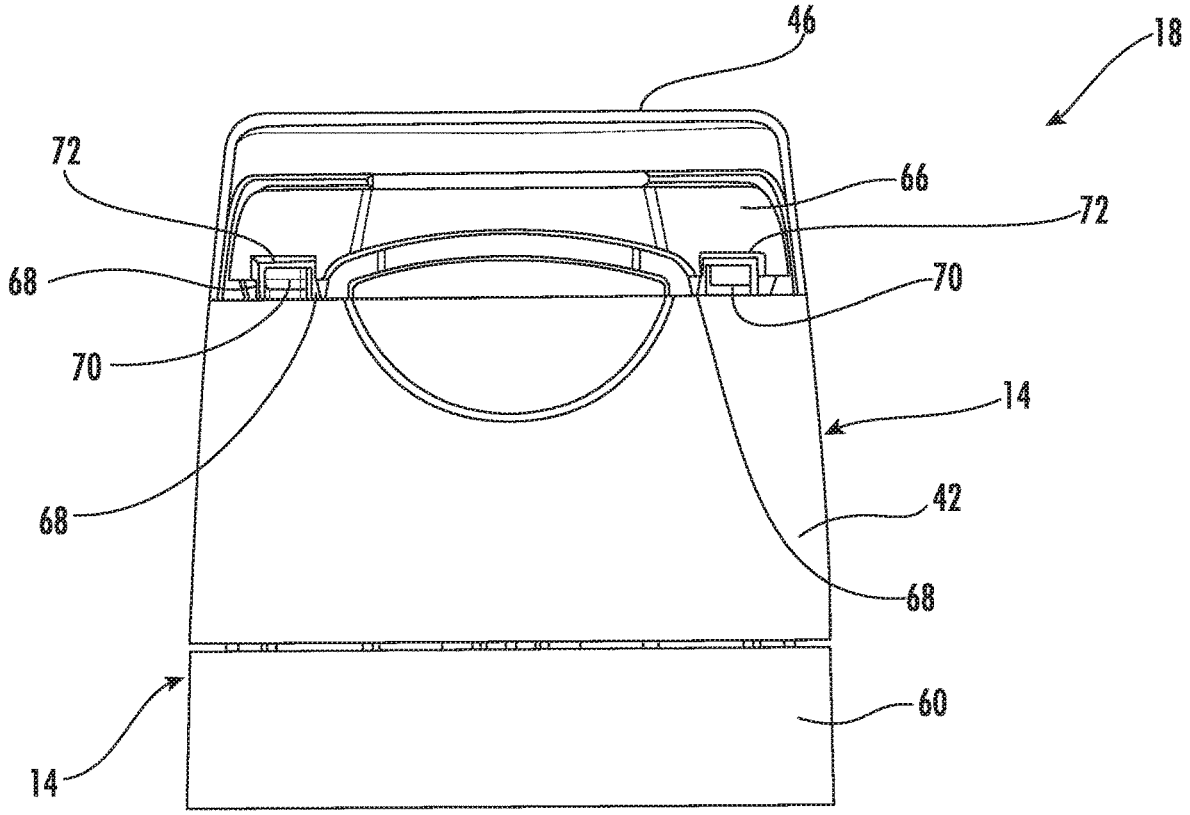
FIG. 6 is a front view thereof.
Figure 7:
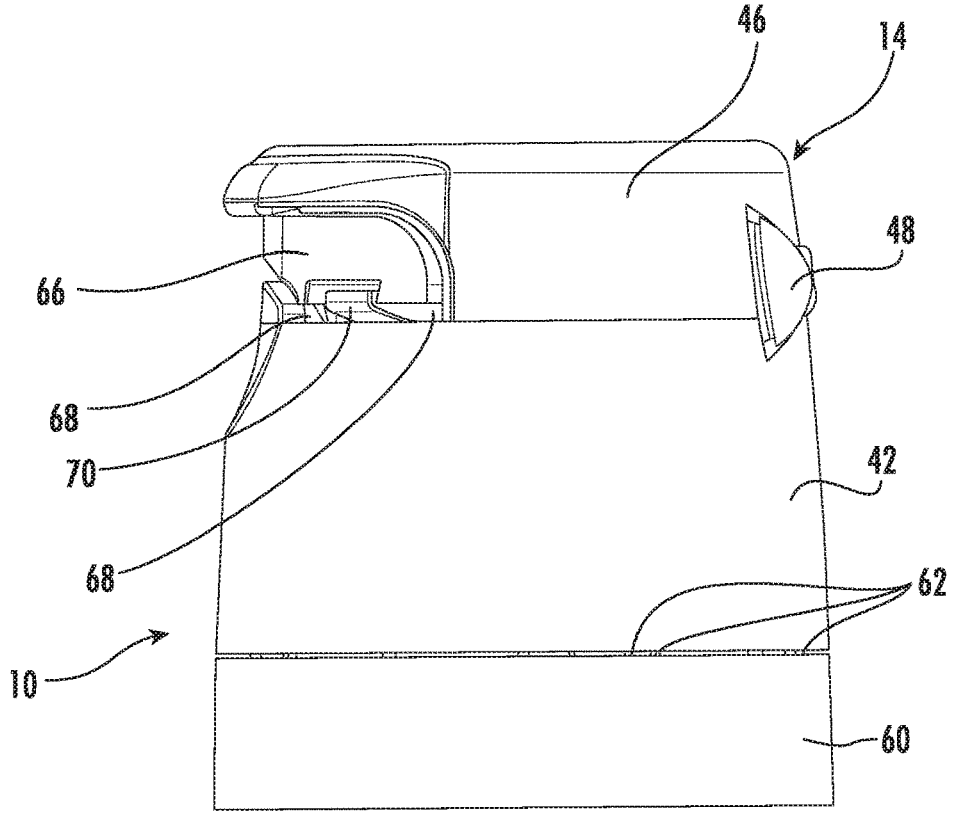
FIG. 7 is a right side view thereof.
Figure 8:
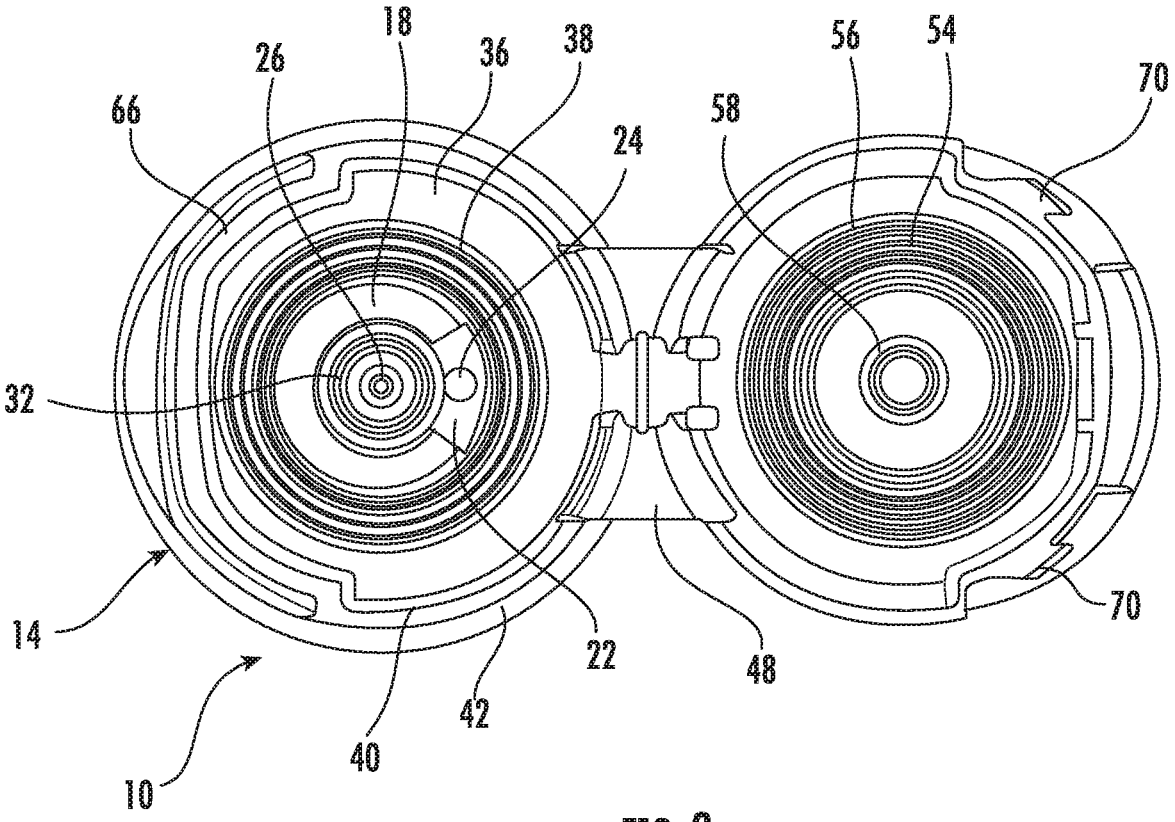
FIG. 8 is a top view thereof.

A tamper-evident skirt ring 60, if included, is connected to a lower peripheral edge of the mounting skirt 42 by a plurality of frangible security elements 62 (See FIG. 5). The skirt ring 60 includes an inwardly turned flanges 64 at the lower edge thereof while the bottle neck 904 includes an external tapered ridge 906. Upon installing the closure 10 onto the container 900, the flange 64 will ride over the tapered ridge 906 and seat itself on the lower edge of the ridge. The arrangement allows the closure 10 to be threaded onto the bottle neck 904 without disturbing the skirt ring 60. However, unscrewing or removing the closure 10 from the container 900 prior to purchase will sever the frangible elements 62 clearly indicating tampering with the product.

An arcuate tamper-evident tear strip 66 is integrally formed with the closure deck 36 where the tear strip is connected to the closure deck by a plurality of frangible elements 68 extending between a lower edge of the tear strip 66 and the closure deck 36. The tear strip 66 is selectively detachable from the closure deck 36 by breaking of the frangible elements 68. The exemplary embodiments include spaced locking tabs 70 formed on an outer surface of the cap 46 wherein the locking tabs 70 are positioned to engage similarly spaced shoulder openings 72 formed on a lower edge on the tear strip 66. In an exemplary embodiment, the spaced pair of locking tabs 70 extend from the front of the cap 46 to provide a distributed lifting force against the tear strip 66. The locking tabs 70 have a tapered surface that slides behind the tear strip 66 and a ledge surface which seats itself beneath the lower shoulder edge. In use, the locking tabs 70 and the shoulder openings 72 cooperate to prevent the cap 46 from being moved from the closed position to the open position without detaching the tear strip 66 from the closure deck 36. Premature lifting cap 46 prior to purchase or intended use will sever the frangible elements 68 clearly indicating tampering with the product.

At the front of the closure body 14 there is further provided a snap ledge 74 which engages with a snap bead 76 formed on the lower peripheral edge of the front of the cap 46. These snap formations firmly hold the front of the cap 46 in a closed position both before and after the tear strip 66 is severed and removed.

Figure 17:
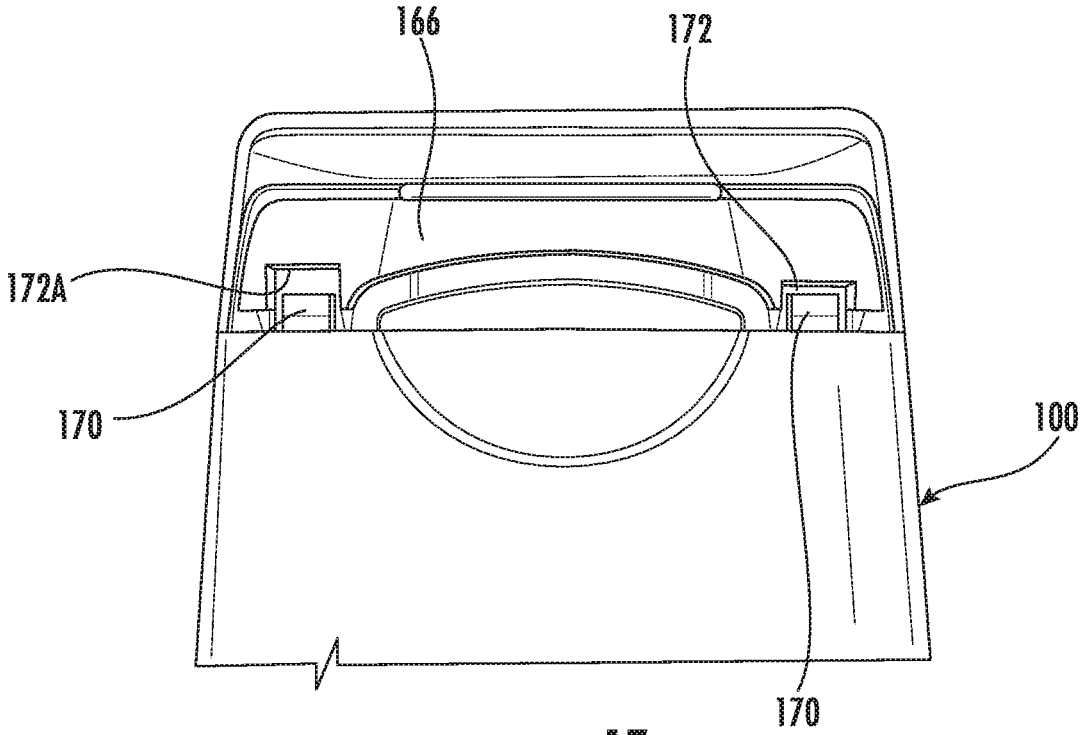
FIG. 17 is a front view of another exemplary embodiment of the dispensing closure.

Turning to FIG. 17, an alternate embodiment of the closure is illustrated and generally indicated at 100. The closure 100 has all of the same features and attributes as the earlier embodiment 10 with the exception of the shape of the shoulder openings 172 of the tamper evident tear strip 166. As best seen in FIG. 17, one of the shoulder openings 172A is enlarged to allow some upward travel of the corresponding locking tab 170 which in turn provides additional leverage to facilitate removal of the tear strip 166. Use and capping operations are the same as previously described.

Figure 18:
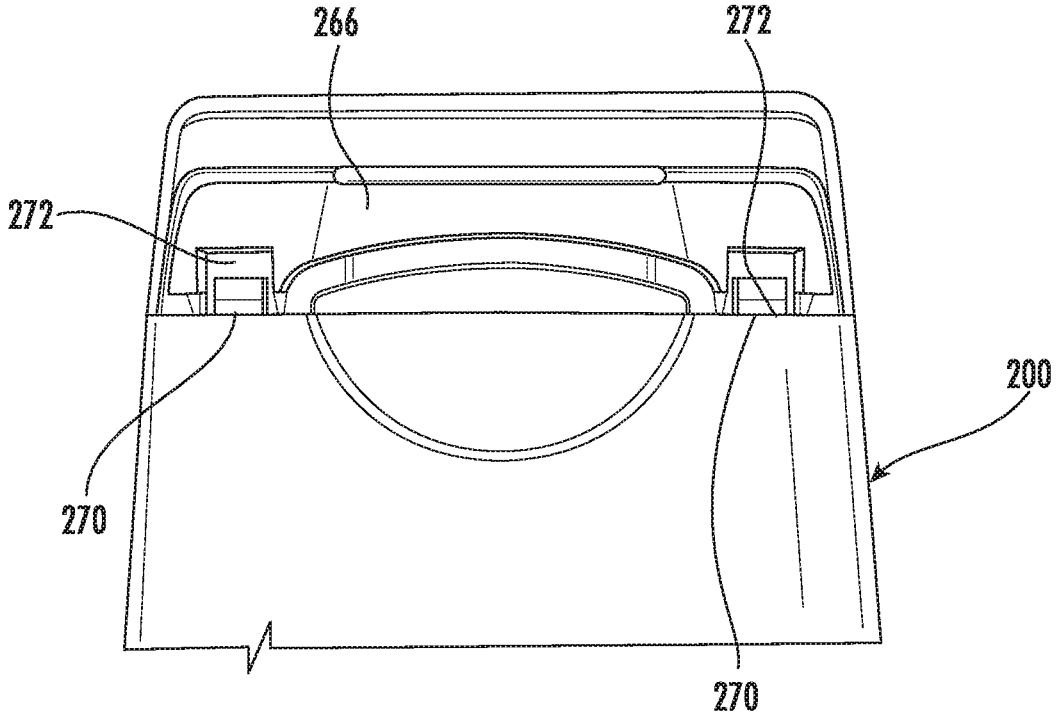
FIG. 18 is a front view of another exemplary embodiment.

In this regard, turning to FIG. 18, another alternate embodiment of the closure is illustrated and generally indicated at 200. The closure 200 has all of the same features and attributes as the earlier embodiments with the exception of the shape of the shoulder openings 272 of the tamper evident tear strip 266. As best seen in FIG. 18, both of the shoulder openings 272 are enlarged to allow upward travel of the corresponding locking tabs 270 which provides additional leverage to facilitate removal of the tear strip 266. Use and capping operations are the same as previously described.

Figure 19:
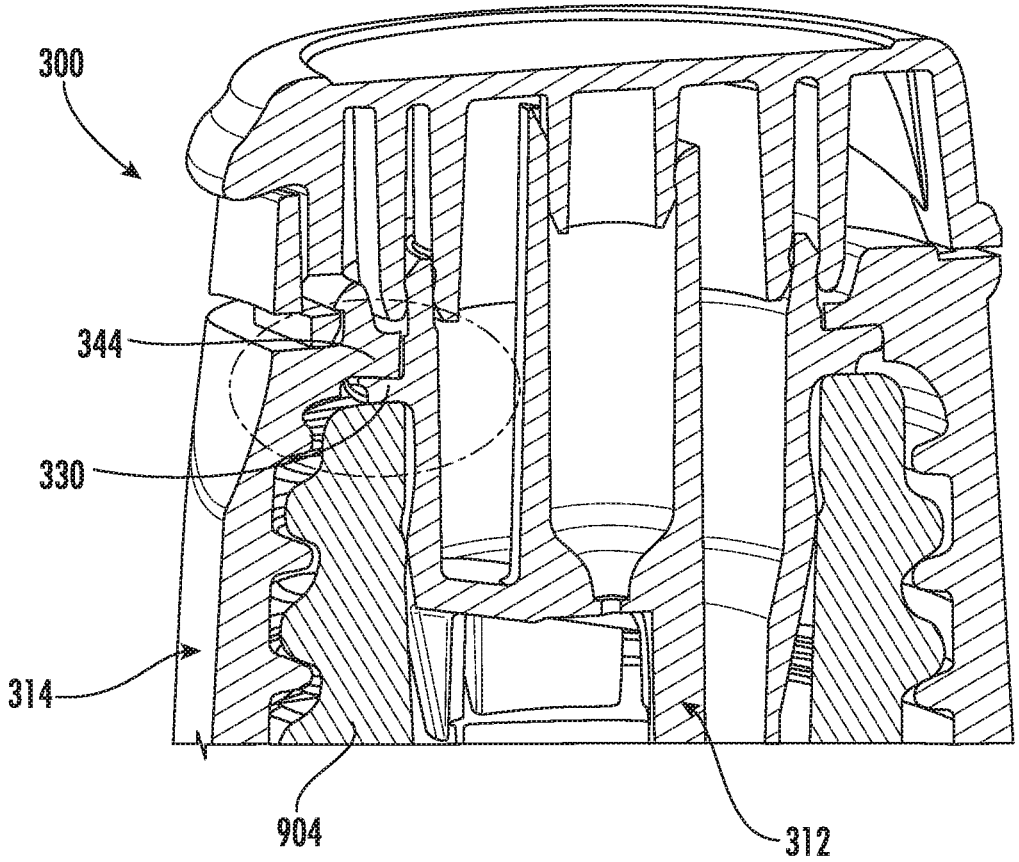
FIG. 19 is a cross-sectional view of another exemplary configuration of the closure assembly.
Figure 20:
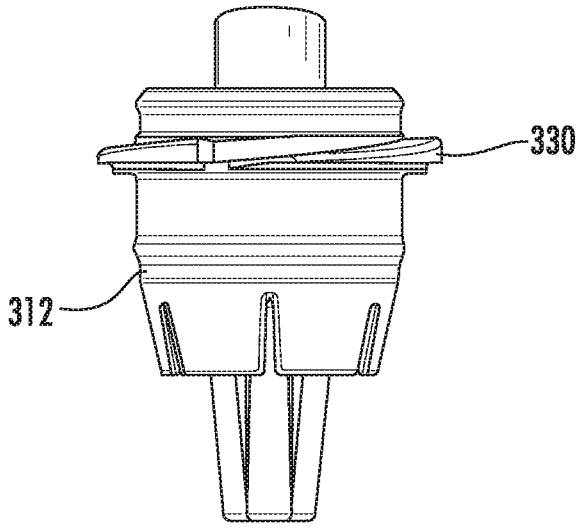
FIG. 20 is front view of the insert body thereof.

FIGS. 19 and 20 illustrates a further configuration of the closure generally indicated at 300 and including an insert body 312 and a closure body 314. The closure 300 has all of the same features and attributes as the earlier embodiments with the exception of the tapered orientation of the helical ramps. As noted above, the helical ramps 30 and 44 had a slight outward and downward taper, thicker nearer the well wall to thinner at the outer edge. In the present embodiment the helical ramps 330 and 344 have an opposing taper (inward and downward), being thinner at the well wall and thicker at the outer edge. As best seen in FIG. 19, the inward taper may provide an improved sealing point of the lower surface of the insert ramps 330 with the inward portions of the upper lip of the container neck 904.

The container, insert body and closure body may in some embodiments be described as being component parts of an integrated closure system.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims

What is claimed is:

1. A dispensing closure comprising:

an insert body comprising:

a drainback well;

a vent tube extending from the drainback well;

a dispensing orifice in the drainback well;

a radial flange extending outward from the drainback well; and circumferentially spaced helical ramps on an upper surface of said flange encircling said drainback well; and a closure body comprising:

an annular closure deck having an inner peripheral terminal edge defining a central opening through the closure body and an outer peripheral edge and a lower surface, the lower surface having circumferentially spaced helical ramps formed directly in the lower surface, the circumferentially spaced helical ramps encircling the inner peripheral edge about the central opening;

an annular inwardly threaded mounting skirt about said peripheral outer edge; and a cap connected to said mounting skirt with a living hinge.

2. The dispensing closure of claim 1 wherein there are 3 circumferentially spaced ramps spaced 120 degrees apart.

3. The dispensing closure of claim 1 further comprising;

an arcuate tamper-evident tear strip integrally formed with said closure deck, said tear strip being connected to said closure deck by a plurality of frangible elements extending between a lower edge of the tear strip and the closure deck; and at least one locking tab formed on an outer surface of said cap, said locking tab being positioned to engage a shoulder opening formed on a lower edge of said tear strip when said cap is in a closed position.

4. The dispensing closure of claim 3 comprising two spaced locking tabs on said cap and corresponding spaced shoulder openings in said tear strip.

5. The dispensing closure of claim 4 wherein said shoulder openings are the same size.

6. The dispensing closure of claim 4 wherein one shoulder opening is larger than the other.

7. The dispensing closure of claim 4 wherein at least one of said shoulder openings is sized to allow some upward movement of the corresponding locking tab.

8. The dispensing closure of claim 1 wherein the helical ramps have an outward taper.

9. The dispensing closure of claim 1 wherein the helical ramps have an inward taper.

10. The dispensing closure of claim 1 wherein said cap and said insert body further includes seals surrounding the dispensing orifice.

11. A dispensing closure comprising:

an insert body comprising:

a drainback well having a side wall and a bottom wall;

a vent tube depending from the bottom wall;

a vent opening in the vent tube;

a tubular spout extending upwardly from the bottom wall;

a dispensing orifice in the tubular spout;

a radial flange extending outward from said side wall; and circumferentially spaced helical ramps on an upper surface of said flange encircling said drainback well, said drainback well receivable within a neck of a container with an outside surface thereof engaging an inner surface of said neck and said flange engaging an upper lip of said neck; and a closure body comprising:

an annular closure deck having an inner peripheral terminal edge defining a central opening through the closure body and an outer peripheral edge and a lower surface, the lower surface having circumferentially spaced helical ramps formed directly in the lower surface, the circumferentially spaced helical ramps encircling the inner peripheral edge about the central opening;

an annular inwardly threaded mounting skirt about said peripheral outer edge; and a cap connected to said mounting skirt with a living hinge.

12. The dispensing closure of claim 11 wherein there are 3 circumferentially spaced ramps spaced 120 degrees apart.

13. The dispensing closure of claim 11 further comprising;

an arcuate tamper-evident tear strip integrally formed with said closure deck, said tear strip being connected to said closure deck by a plurality of frangible elements extending between a lower edge of the tear strip and the closure deck; and at least one locking tab formed on an outer surface of said cap, said locking tab being positioned to engage a shoulder opening formed on a lower edge of said tear strip when said cap is in a closed position.

14. The dispensing closure of claim 13 comprising two spaced locking tabs on said cap and corresponding spaced shoulder openings in said tear strip.

15. The dispensing closure of claim 14 wherein said shoulder openings are the same size.

16. The dispensing closure of claim 14 wherein one shoulder opening is larger than the other.

17. The dispensing closure of claim 14 wherein at least one of said shoulder openings is sized to allow some upward movement of the corresponding locking tab.

18. The dispensing closure of claim 11 wherein the helical ramps have an outward taper.

19. The dispensing closure of claim 11 wherein the helical ramps have an inward taper.

20. The dispensing closure of claim 11 wherein said cap and said insert body further includes seals surrounding the dispensing orifice.

* * * * *